US007959484B2

(12) United States Patent
Fahnline

(10) Patent No.: US 7,959,484 B2
(45) Date of Patent: Jun. 14, 2011

(54) BATHTUB WHIRLPOOL TOY

(76) Inventor: Richard Alan Fahnline, Evergreen, CO (US)

( * ) Notice: Subject to any disclaimer, the term of this patent is extended or adjusted under 35 U.S.C. 154(b) by 644 days.

(21) Appl. No.: 12/012,550

(22) Filed: Feb. 4, 2008

(65) Prior Publication Data

US 2009/0197501 A1 Aug. 6, 2009

(51) Int. Cl.
*A63H 23/00* (2006.01)
*A63H 29/10* (2006.01)

(52) U.S. Cl. ..... 446/153; 446/176

(58) Field of Classification Search ..... 446/153, 446/159, 167, 176, 178, 180, 217, 218, 267, 446/483; 4/496, 541.1–541.6; 472/65, 67, 472/128, 129, 137; 434/276; 40/406, 427, 40/439, 440

See application file for complete search history.

(56) References Cited

U.S. PATENT DOCUMENTS

| | | | | |
|---|---|---|---|---|
| 536,718 | A | 7/1897 | Wharton, Jr. | |
| 3,010,247 | A * | 11/1961 | Shapiro | 446/159 |
| 3,099,986 | A * | 8/1963 | Guelfi | 4/541.6 |
| 3,308,574 | A * | 3/1967 | Schneider | 446/153 |
| 3,372,873 | A | 3/1968 | Weiss | |
| 4,206,565 | A | 6/1980 | Goldfarb | |
| 4,258,912 | A | 3/1981 | Reighart, II | |
| 4,625,780 | A * | 12/1986 | Burnham | 141/319 |
| D310,717 | S | 9/1990 | Heiligenstein | |
| 5,096,467 | A | 3/1992 | Matsui | |
| 5,272,604 | A | 12/1993 | Lin | |
| 5,616,083 | A | 4/1997 | Subbaramen | |
| D428,155 | S | 7/2000 | Chalberg et al. | |
| 6,241,359 | B1 | 6/2001 | Lin | |
| 6,295,749 | B1 * | 10/2001 | Lin | 40/406 |
| 6,681,508 | B2 | 1/2004 | Unger et al. | |

* cited by examiner

*Primary Examiner* — Gene Kim
*Assistant Examiner* — Alyssa M Hylinski
(74) *Attorney, Agent, or Firm* — Trenner Law Firm, LLC; Mark D. Trenner

(57) ABSTRACT

A bathtub whirlpool toy and educational device has a bottom and gasket designed to allow the device to fit over the drain of a household fixture such as a bathtub or sink. The device has a generally cylindrical interior space having inlet slots set at an angle, so that water entering the interior from the bath will begin to rotate immediately. A central outlet leads to a recuperation chamber having an offset recuperation chamber outlet allowing the recuperation chamber outlet to sit directly over a bathtub drain. The recuperation chamber may have a plurality of vanes/fins designed to reduce water circulation and increase water flow. An adapter may allow the user to alter the size and shape of the interior space outlet aperture, and may be fixable in place or movable during use so as to allow the user to alter the vortex/whirlpool dynamically.

17 Claims, 9 Drawing Sheets

BATHTUB WHIRLPOOL TOY

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

CROSS-REFERENCE TO RELATED APPLICATIONS

N/A

FIELD OF THE INVENTION

This invention relates generally to toys, and specifically to bathtub toys.

STATEMENT REGARDING FEDERALLY FUNDED RESEARCH

This invention was not made under contract with an agency of the US Government, nor by any agency of the US Government.

BACKGROUND OF THE INVENTION

Toys for bathtub use tend to fall into a small number of types. There are floating devices such as rubber ducks. There are squirting devices like squirt guns. There are small numbers of animals which absorb water to expand from a tiny size to a small size. However, there are a limited number of scientific toys.

Scientific toys for the bath tend to be demonstrations of buoyancy: submarines and the like. One typical item would be U.S. Pat. No. 4,206,565 issued Jun. 10, 1980 to Goldfarb.

The applicant is unaware of any prior art relevant to the concept of a bathtub whirlpool toy. Searching in the database of the United States Patent and Trademark Office reveals numerous references to "whirlpool bathtubs", which are not toys at all but rather bathtubs with jets to provide a massage to a user of the tub. U.S. Design Pat. No. D428,155 issued to Chalberg et al Jul. 11, 2000 is an example of this, as is U.S. Design Pat. No. D310,717 issued to Heiligenstein on Sept. 18, 1990.

Another irrelevant category of items concerns water park and amusement park rides. A number of such devices have whirlpools, waves, tubes or the like. U.S. Pat. No. 5,616,083 issued to Subbaraman et al on Apr. 1, 1997 is an example of this, as is U.S. Pat. No. 586,718 issued Jul. 20, 1897 to Wharton, Jr.

Another un-related category of items are devices for use in creating an air vortex using a fan, air jets, and similar items. U.S. Pat. No. 5,096,467 issued to Matsui on Mar. 17, 2002 is an example of this.

Yet another type of item un-related to the toy field is material handling apparatus for scientific or production work, for example, U.S. Pat. No. 3,372,873 issued to Weiss on Mar. 12, 1968.

Finally, a number of display items having clear cylindrical sides and machinery for creating a whirlpool in a standing body of liquid within the cylinder are known. None of these relate to bathtubs, drain powered vortexes or the like.

Examples include: U.S. Pat. No. 4,258,912 issued Mar. 31, 1981 to Reighart, II and U.S. Pat. No. 5,272,604 to Lin on Dec. 21, 1993, and U.S. Pat. No. 6,241,359 issued Jun. 5, 2001 to Lin and U.S. Pat. No. 6,295,749 issued Oct. 2, 2001 to Lin and U.S. Pat. No. 6,681,508 issued Jan. 27, 2004 to Unger et al.

None of these devices teach that an ordinary, non-jetted bathtub drain may be used to power a whirlpool for education and amusement of children.

None of these devices teach a cylindrical body having a drain dimensioned and configured to sit atop a household bath or sink drain, a recuperation chamber, a gasket sized to secure the device to a bathtub surface, and a hole having liquid access to a household drain.

SUMMARY OF THE INVENTION

General Summary

A bathtub whirlpool toy and educational device has a bottom and gasket designed to allow the device to fit over the drain of a household fixture such as a bathtub or sink, even though such drains may be set quite close to the edge of the bathtub, and most bathtubs do not have flat bottoms.

The device has a generally cylindrical interior space with a clear or open top, and further having inlet slots set at an angle, so that water entering the interior from the bath will begin to rotate immediately upon entrance. A centrally placed outlet in the bottom of the interior space leads to a recuperation chamber having an offset recuperation chamber outlet allowing the recuperation chamber outlet to sit directly over a bathtub drain and thus allowing water to exit the recuperation chamber directly to the bathtub drain. The recuperation chamber may have a plurality of vanes/fins designed to recover rotational kinetic energy content within the vortex, thus reducing the resistance to the flow of liquid within the toy, which in turn increases the flow rate and the size of the whirlpool formed.

An optional adapter may allow the user to alter the size and shape of the interior space outlet aperture, and may be fixable in place or movable during use so as to allow the user to alter the vortex/whirlpool dynamically. The adapter may have a shield portion blocking a portion of the vortex and an arm portion allowing the adapter to be moved or adjusted while a vortex/whirlpool is in progress. The arm portion may bend upwards, may pass through an inlet slot, or may pass through a special arm adjustment slot in the side of the side walls of the cylindrical interior.

Summary in Reference to Claims

It is therefore another aspect, advantage, objective and embodiment of the invention, in addition to those discussed previously, to provide whirlpool toy for use in a partially enclosed household fixture having water therein and having a drain, the whirlpool toy comprising:

- a generally cylindrical body having a first generally cylindrical interior space, the body having a top allowing a clear view of the first interior space and at least one generally vertical side wall;
- a first outlet aperture in a bottom of the first interior space, the first outlet aperture located near a center of the bottom of the first interior space;
- a first recuperation chamber connected to the first interior space by the first outlet aperture, the first recuperation chamber having an open bottom of the first recuperation chamber offering a flow connection to the exterior of the device; and
- at least one inlet slot extending vertically up a substantial portion of the at least one generally vertical side wall.

It is therefore another aspect, advantage, objective and embodiment of the invention to provide a whirlpool toy wherein the first recuperation chamber further comprises:

fins located within the first recuperation chamber and disposed so as to produce turbulent flow of water within the first recuperation chamber, whereby flow out of the first recuperation chamber is increased.

It is therefore yet another aspect, advantage, objective and embodiment of the invention to provide a whirlpool toy wherein the inlet slot further comprises:

first and second edges of the slot, wherein the first edge is set further from a center of the interior space than the second edge, whereby the slot is disposed at along a chord line of the generally cylindrical body, whereby water entering the first interior space from such household fixture does not move in a straight line towards the center of the interior space.

It is therefore another aspect, advantage, objective and embodiment of the invention to provide a whirlpool toy, wherein the cylindrical side wall and the inlet slot and the bottom of the first interior space are substantially smooth, whereby water moving within the first interior space travels in a laminar flow.

It is therefore another aspect, advantage, objective and embodiment of the invention to provide a whirlpool toy further comprising:

at least one gasket dimensioned and configured to secure the device to the bottom of such household fixture.

It is therefore another aspect, advantage, objective and embodiment of the invention to provide a whirlpool toy wherein the first recuperation chamber is located, dimensioned and configured to offer unimpeded water flow from the first recuperation chamber to such drain.

It is therefore another aspect, advantage, objective and embodiment of the invention to provide a whirlpool toy wherein the first recuperation chamber is defined by the bottom of the first interior space and the side wall of the body.

It is therefore another aspect, advantage, objective and embodiment of the invention to provide a whirlpool toy wherein the top allowing a view of the interior of the device further comprises: an open top.

It is therefore another aspect, advantage, objective and embodiment of the invention to provide a whirlpool toy wherein the top allowing a view of the interior of the device further comprises: a transparent top.

It is therefore another aspect, advantage, objective and embodiment of the invention to provide a whirlpool toy further comprising:

a vortex control adapter having a hand grip extension, a shield disposed at end of the hand grip extension, and at least one shield aperture passing through the shield, the shield being larger than the first outlet aperture and the first shield aperture being smaller than the first outlet aperture.

It is therefore another aspect, advantage, objective and embodiment of the invention to provide a whirlpool toy wherein the vortex control adapter further comprises: a second shield aperture passing through the shield, the second shield aperture being a different size than the first outlet aperture.

It is therefore another aspect, advantage, objective and embodiment of the invention to provide a whirlpool toy, wherein the edges of the slot are substantially streamlined to reduce turbulent flow.

It is therefore another aspect, advantage, objective and embodiment of the invention to provide a whirlpool toy wherein the inlet slot further comprises:

at least one entry vane directing water flowing through the inlet vane in a direction substantially perpendicular to the center of the first interior space.

It is therefore another aspect, advantage, objective and embodiment of the invention to provide a whirlpool toy wherein the hand grip extension further extends a sufficient distance to extend out of the first interior space, whereby the user may manipulate the adapter while the toy is generating a vortex.

INDEX OF THE REFERENCE NUMERALS

Figure 1:
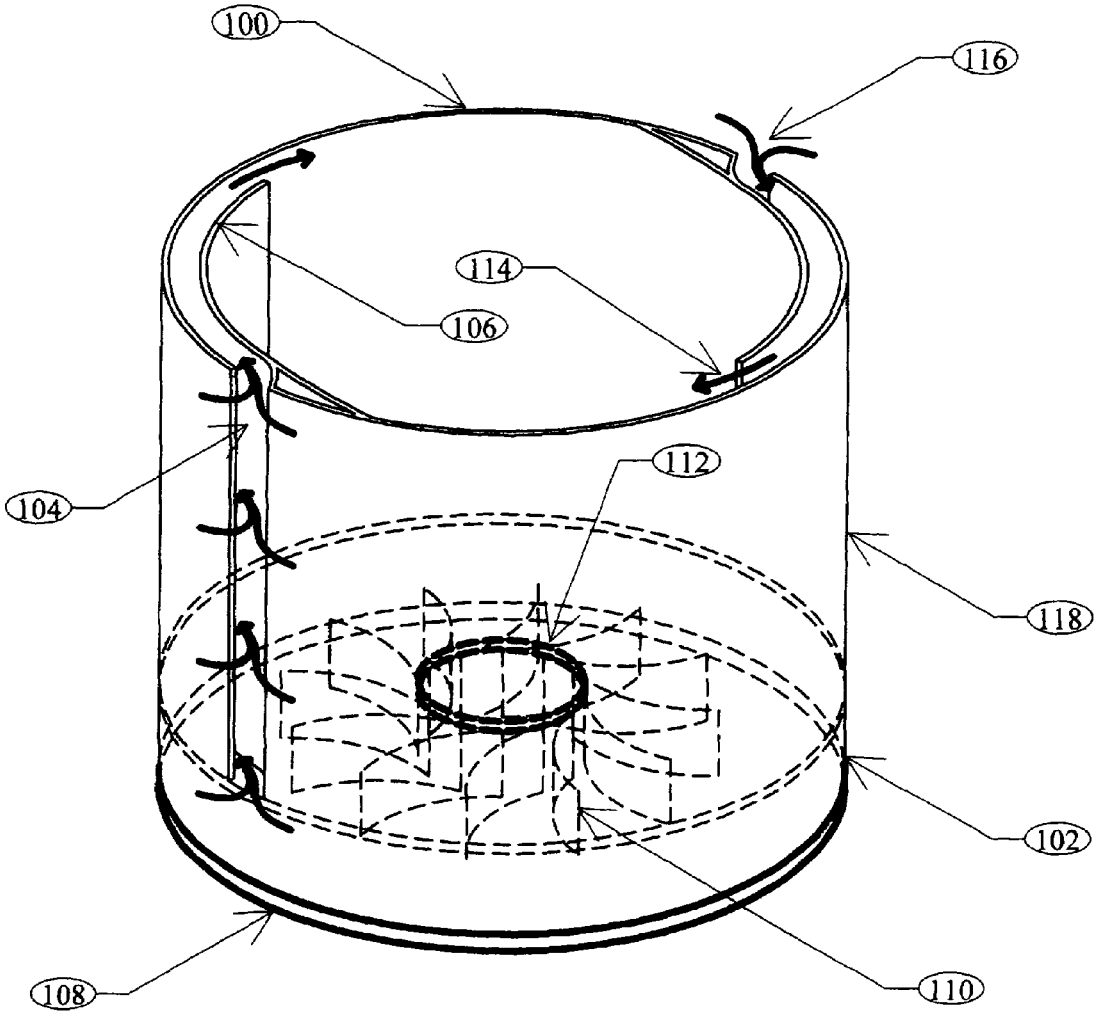
FIG. 1 is a partially transparent perspective view of a first embodiment of the device.

Device 100
Lower recuperation chamber 102
Inlet slot 104
Slot wall 106
Lip/gasket 108
Recuperation fin/vane 110
Interior space outlet aperture 112
Desirable vortex flow 114
Inlet flow 116
Upper vortex chamber wall 118
Household fixture 202
Bottom of household fixture 204
Device 206
Device/sidewall with gasket 304
Recuperation/lower chamber 306
Interior space outlet aperture 308
Household fixture drain 310
Water 312
Possible vortex 314
Possible vortex 320
Household fixture bottom 322
Side wall 402
Interior space 404
Top 406

Inlet slot 408
Inlet slot edges 410, 412
Interior outlet aperture 414
Interior bottom 416
Recuperation chamber 418
Recuperation vane/fin 420
Household fixture bottom 422
Gasket 424
Household fixture drain 426
Recuperation chamber 502
Side wall of recuperation chamber 504
Interior outlet aperture 506
Vanes 510
Adapter shield 602
Adapter shield hand grip extension 604
First aperture 606
Second aperture 608
Third aperture 610
Interior space 702
First side wall 704
Second side wall 706
Interior bottom 708
Inlet slots 710, 712
First slot edge 714
Second slot edge 716
Gasket 722
Aperture 800
Lip 802
Adapter handle extension 804
Aperture and lip 900
Shield 902
Handle extension 904
Interior outlet aperture 1000
Vane/fin 1002
Gasket/lip 1004
Recuperation outlet aperture 1006
Flow 1008
Interior outlet aperture 1100
Vane/fin 1102
Gasket/lip 1104
Recuperation outlet aperture 1106
Flow 1108

DETAILED DESCRIPTION

FIG. 1 is a partially transparent perspective view of a first embodiment of the device 100. Lower recuperation chamber 102 and upper recuperation chamber (defined by wall 118) are separated by a floor into two different chambers, connected only by interior space outlet aperture 112. A vortex may be easily formed in the upper chamber, while the lower chamber (defined by the bottom of the bathtub and the bottom of the interior vortex chamber) aids in speeding flow and preventing water from developing undesirable back pressure by means of recuperation fin/vane 110, which recovers kinetic energy from the vortex.

Inlet slot 104 is defined by inner slot wall 106 and accepts inlet flow 116, water which comes in from a large sink or bathtub partially full of water. Inner slot wall 106 channels and directs the flow to produce a desirable vortex flow 114.

Lip/gasket 108 helps seal the recuperation chamber from the ambient water in the household fixture so as to aid in preventing water from bypassing the upper chamber.

Figure 7:
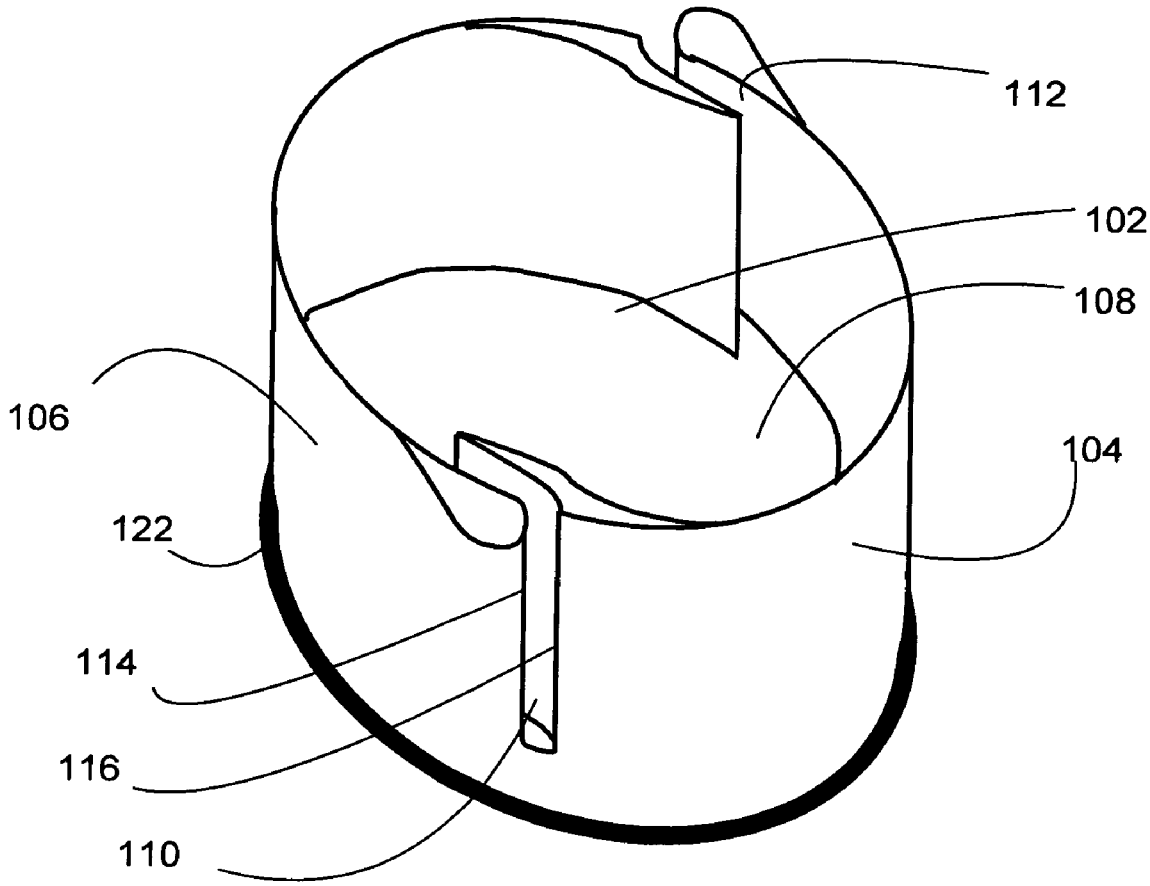
FIG. 7 is a perspective view of a seventh embodiment of the device.

FIG. 7 is a perspective view of a first embodiment of the device. In this perspective view, the center of the bottom, and the outlet therefrom is not visible, nor is the recuperation chamber located thereunder.

Interior space 702 has interior bottom 708 and first and second side walls 704, 706. Interior bottom 708 and side walls 704, 706 define the interior space, which is generally a regular cylinder having a round planform. (In alternative embodiments, the interior space could conceivably be shapes other than a circular column, such as an elliptical planform, or a frustum or conical shape, so long as water flow in enhanced by the shape.) Thus the overall device takes on the aspect of an open topped or clear topped barrel. The body of the device may be molded of plastic or other polymer, made of metal, wood, composites and other similar materials. The materials selected may be wholly or partially transparent.

Inlet slots 710, 712 allow water to flow into the interior space 702 from the water-filled household fixture in which it is placed. Inlets 710, 712 are defined by edges such as first slot edge 714 and second slot edge 716. It will be seen that the slot edges 714, 716 may be streamlined in shape so as to promote smooth water flow within the device in order to minimize pressure loss within the inlet vanes and promote even flow within the upper chamber. Importantly, slots 714, 716 may be set at an angle to the straight radial path to the center (not seen in FIG. 1) of the interior space. The angle of the slots will make a chord with the overall circular planform of the device, so water entering the device will enter traveling sideways, and the slots will tend toward the exact orthogonal so as to provide the largest angle possible to the flow within the barrel shaped interior space. Any number of such slots may be used, and the size and placement may be varied. The slots may also take the form of rows of apertures or rows of jets, which rows may be arrayed either vertically or horizontally or a combination of both, and this definition of slot is specifically included within the scope of the invention.

Handles may provide a convenient grip on other alternative embodiments of the device, and may further provide a location at which a lanyard, string, chain or the like may be secured.

Gasket 722 may be a relatively soft and conformable material which allows the device to conform to the bottom of typical household water fixtures like sinks and bathtubs. The conformance to the shape of the bottom of the bathtub or sink is important so as to force water exiting the fixture to pass through the device.

It will be appreciated that the dimensions of the device, especially the height and width, will alter the characteristics of the vortex created therein. For a single example, greater height provides a greater "head" of pressure to generate sideways motion and the vortex. It will be appreciated that the dimensions of the slots will dramatically alter the characteristics of the vortex in a similar manner.

Figure 2:
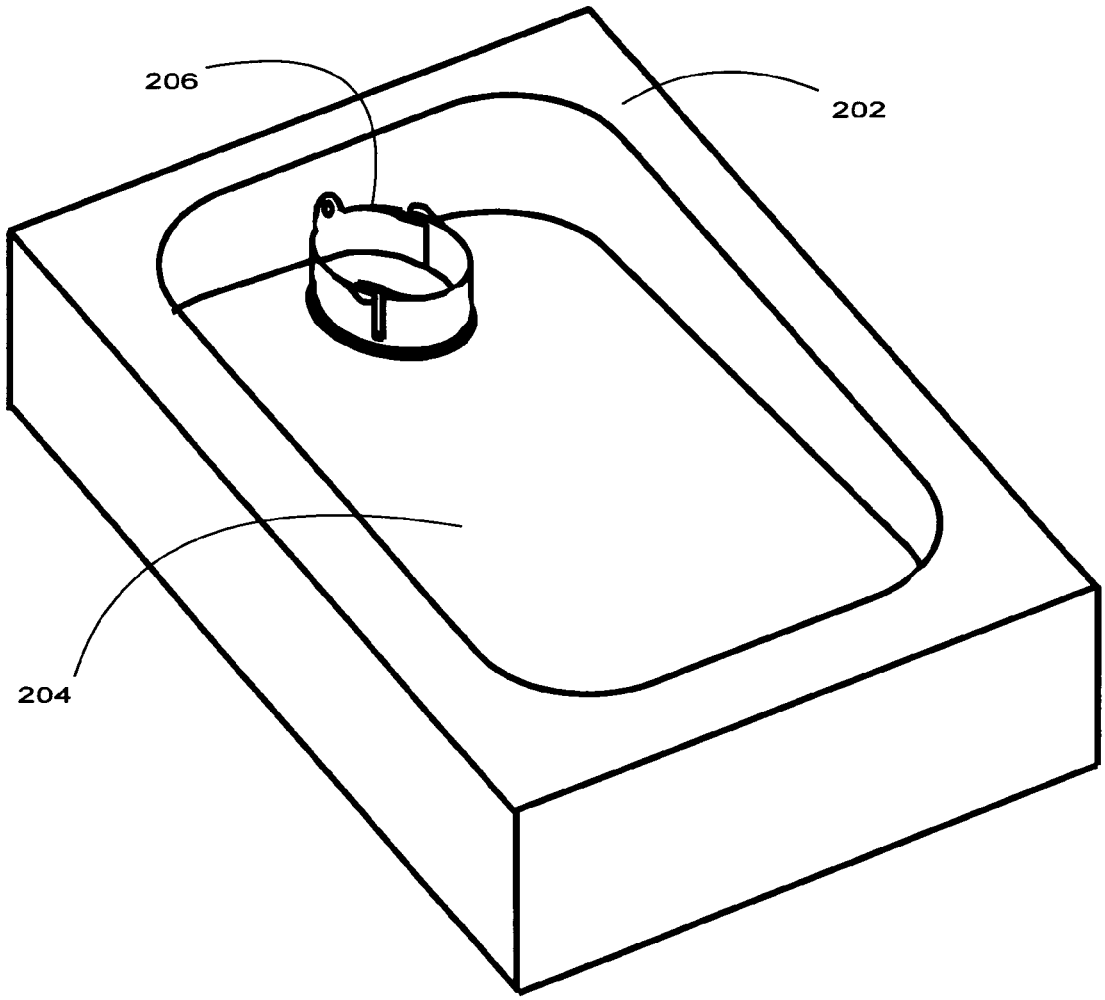
FIG. 2 is a perspective view of the first embodiment in use in a household fixture such as a bathtub.

FIG. 2 is a perspective view of the first embodiment in use in a household fixture such as a bathtub. Household fixture 202 may have a bottom of household fixture 204, which may not be entirely flat nor regular. Device 206 may be set into the fixture at a location over the drain from the device (drain not seen due to device 206). It will be appreciated that the central axis of the generally cylindrical device may be offset from the drain of the bathtub, thus allowing formation of a wider body and vortex within.

In use, the fixture is filled with water and the drain is opened. Gaskets and the body of the device 206 will impede water from directly exiting via the drain, and force it through the slots/apertures on the side of the device at which point, the laminar and rotating water within the device will swiftly organize into a well defined vortex, a result confirmed by testing.

Figure 3A:
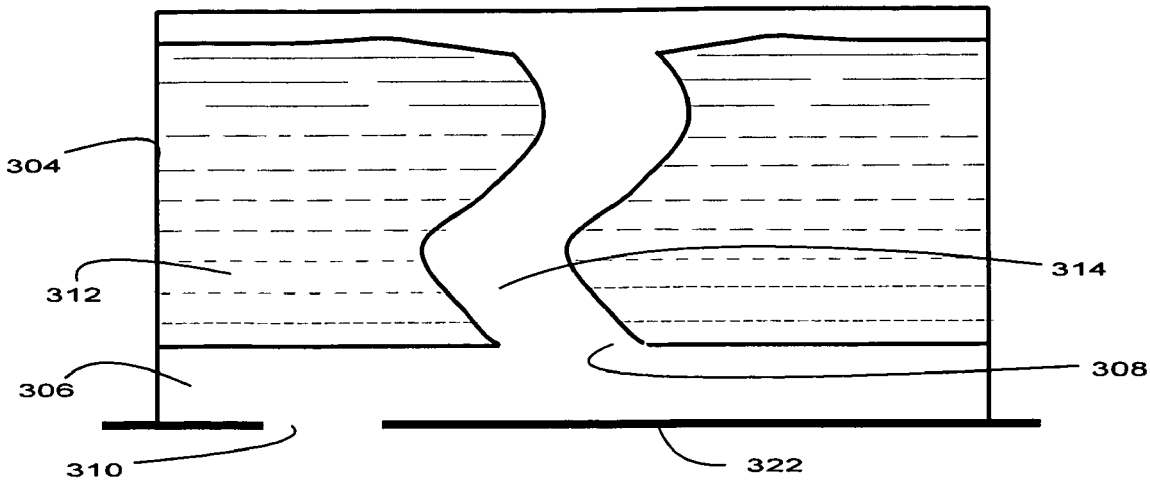
FIG. 3*a* is a cross-sectional diagram of a second embodiment of the device, showing a preferred water flow and a first possible vortex pattern.
Figure 3B:
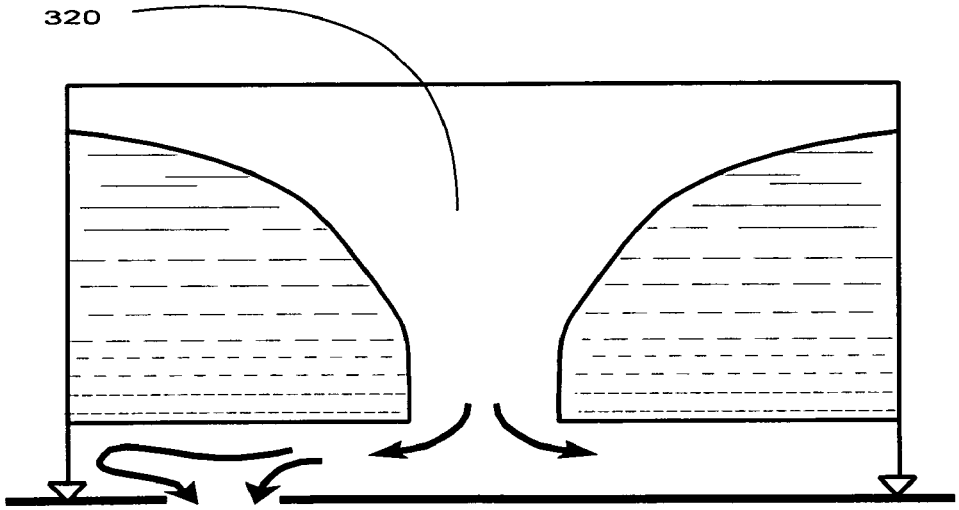
FIG. 3*b* is a cross-sectional diagram of a third embodiment of the device, showing an undesirable water flow and a second possible (desirable) vortex pattern.

FIG. 3*a* is a cross-sectional diagram of a second embodiment of the device, showing a preferred water flow and a first possible vortex pattern, while FIG. 3*b* is a cross-sectional diagram of a third embodiment of the device, showing an undesirable water flow and a second possible (desirable) vortex pattern. Device/sidewall 304 defines both the upper/vortex interior space and also lower recuperation chamber 306, which recuperation chamber is fed by water flowing out from interior space outlet aperture 308. Water may then exit the recuperation chamber 306 via the recuperation chamber's open bottom, or via any opening if the chamber has a bottom with an aperture. A bottom of the chamber is felt to be less desirable in terms of forming a large vortex, as an open bottom would appear to offer the best possible flow. A gasket may be provided on sidewall 304 or may be omitted, depending on embodiment, construction techniques and materials of the sidewall and other considerations.

Water flow paths are crucial to the invention. Water 312 may have within it either possible vortex 314, possible vortex 320, or any other myriad shapes including vortices which are not straight (see vortex 314) or are conical (vortex 320), and so on.

Water flow arrows mark desirably speedy water flow from the recuperation chamber 306. It will be understood that slow moving water near or at the first aperture (the interior space outlet/recuperation chamber inlet 308, that is, the aperture in the bottom of the interior space and the top of the recuperation chamber) will impede the flow of water in the interior chamber, which water 312 desirably moves quite quickly. Thus undesirable water flow may in embodiments be avoided: swirling water in the recuperation chamber should have the energy removed so that it quickly exits via household fixture drain outlet 310. The household fixture bottom 322 may define the bottom of the recuperation chamber 306.

Figure 4:
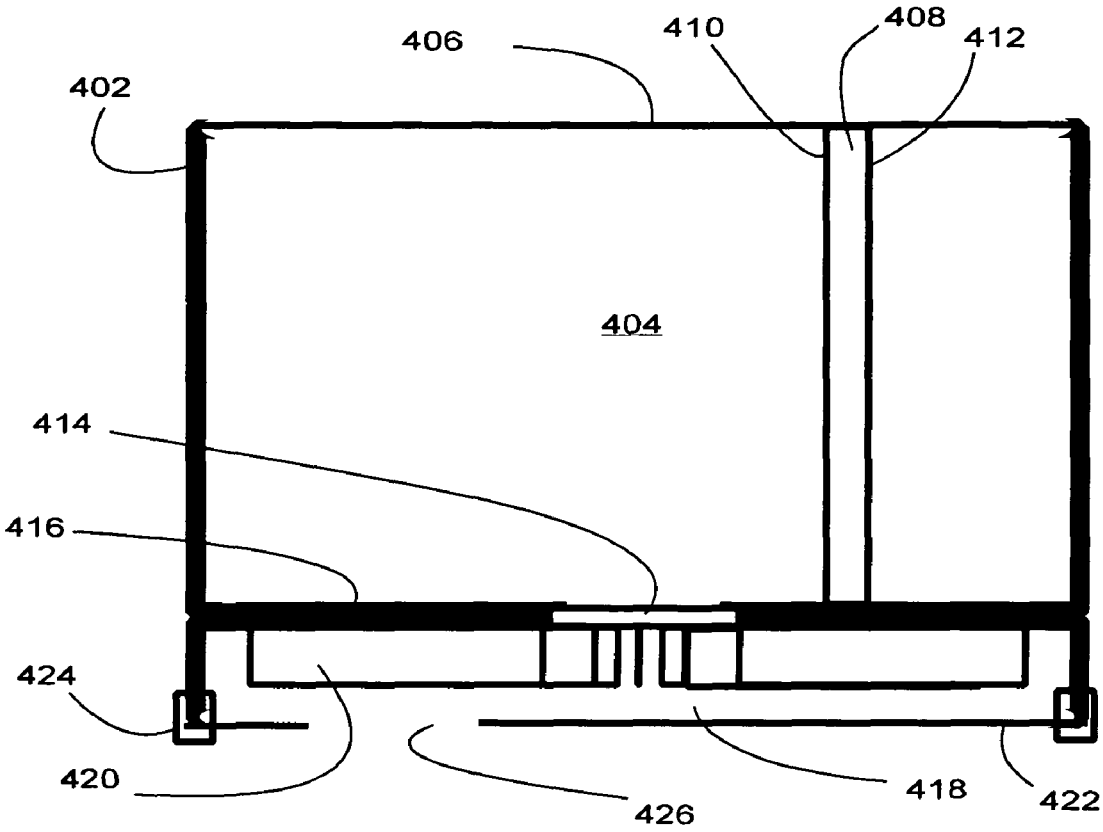
FIG. 4 is a cross sectional diagram of a fourth embodiment of the device, showing details of the recuperation chamber.

FIG. 4 is a cross sectional diagram of a fourth embodiment of the device, showing details of the recuperation chamber. Side wall 402 defines interior space 404 having top 406. In the presently preferred embodiment and best mode now contemplated, top 406 is an opening allowing users to experiment and play with the vortex, for example by feeling it, placing water toys into it, or using an adapter (explained in reference to FIG. 6) in a dynamic/interactive mode. In alternative embodiments, however, top 406 may be transparent, a smaller aperture, screened and so on.

Inlet slot 408 is defined by inlet slot edges 410, 412, while interior outlet aperture 414 may be clearly seen in the center of the interior bottom 416. The interior outlet aperture 414 may be placed at locations other than the center of the interior bottom 416 (that is, locations away from the center of the interior space 404) in alternative embodiments.

Recuperation chamber 418 (again defined by household fixture bottom 422) may have therein vane/fin 420 or a plurality thereof, which may function to remove kinetic energy from the water entering the chamber via aperture 414. Water may then flow more quickly to household fixture drain 422 and thus may exit more rapidly.

Gasket 424 may be seen more clearly as well. Note that the gasket 424 may in embodiments be eliminated, if the material of the device or the shape of the device allows a workable seal with the bottom of the bathtub/fixture.

It may be seen once again that the bathtub drain may be offset from the drain of the interior space/vortex chamber, and that the bathtub surface combines with the side walls of the body and the bottom of the vortex chamber to define the recuperation chamber.

Figure 5:
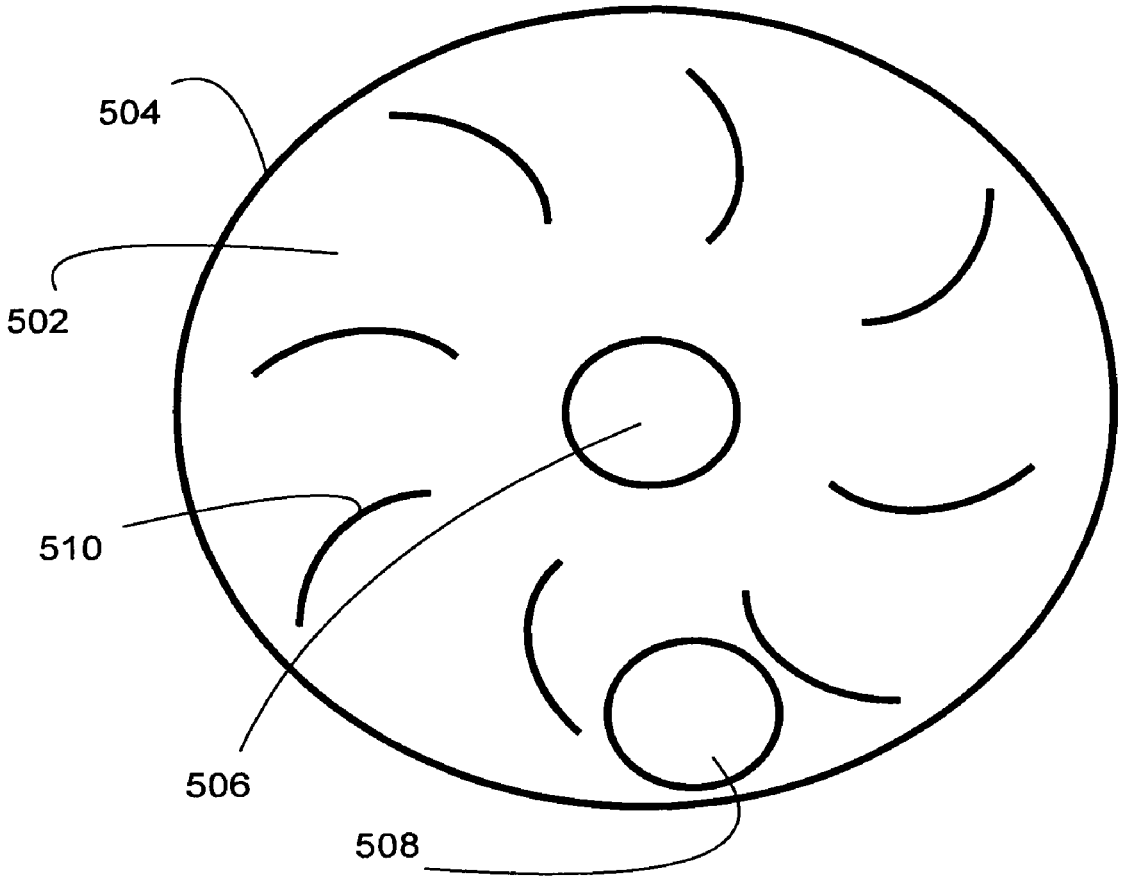
FIG. 5 is partially transparent bottom view of the device showing details of a fifth embodiment and the recuperation chamber.

FIG. 5 is partially transparent bottom view of the device showing details of a fifth embodiment and the recuperation chamber. Recuperation chamber 502 is defined by side wall of recuperation chamber 504 and has interior outlet aperture 506 (which of course functions as an inlet for the recuperation chamber 502) and further has recuperation outlet aperture 508. Vanes/fins 510 may be straight and still function to recover kinetic energy from the water, or may be shallow curves, angled, bent and other shapes. Fins as used herein includes patterns of posts or pins, bumps, ridges, irregularities, and so on. The vanes/fins may extend entirely across the chamber from top to bottom, or may extend partially from either the top or bottom of the chamber, or may extend from the sides or center of the chamber, may be irregular, and may vary in number.

Figure 6:
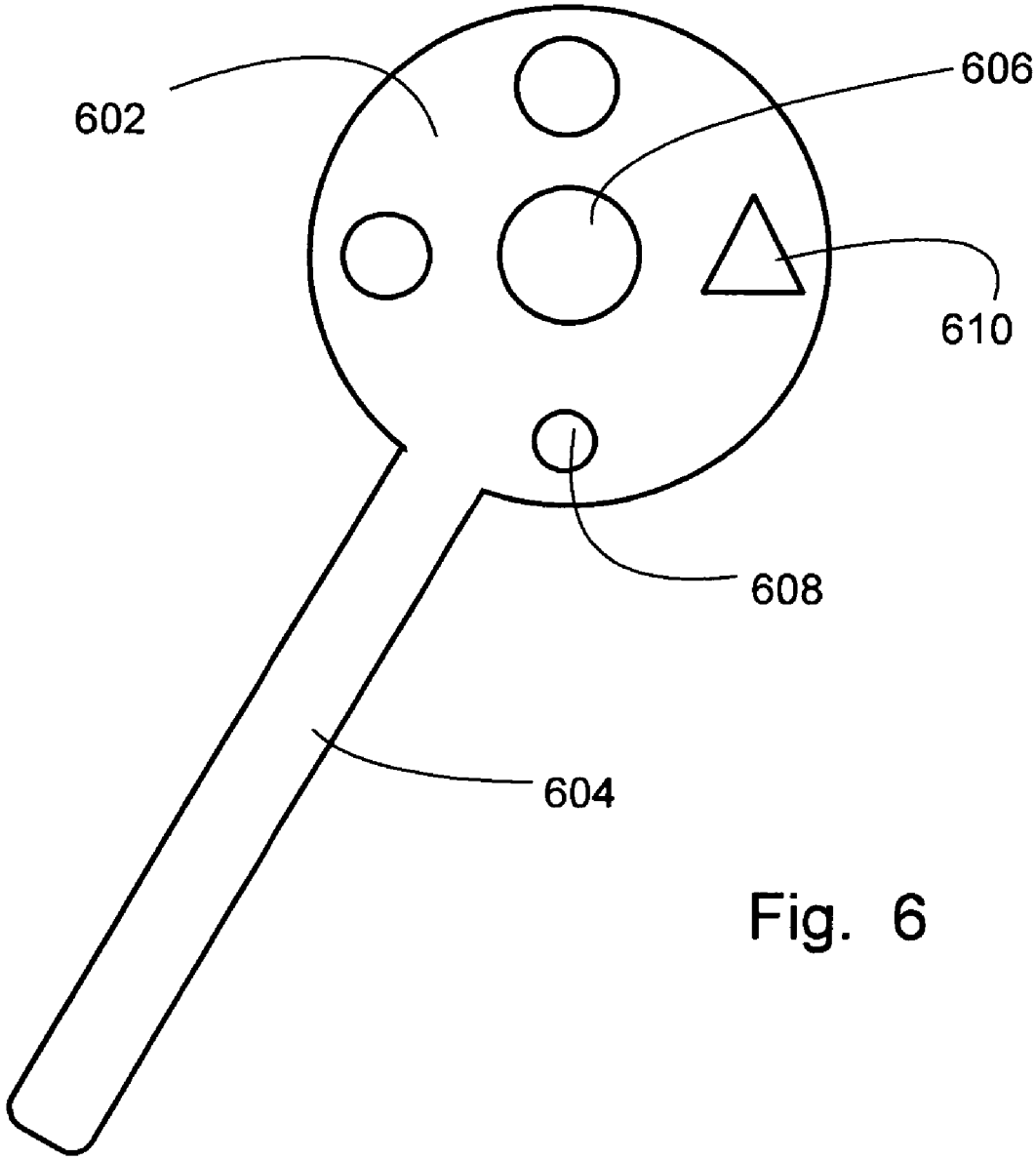
FIG. 6 is a planform view of an adapter according to the device, allowing interactive and dynamic user control of the vortex.

FIG. 6 is a planform view of an adapter according to the device, allowing interactive and dynamic user control of the vortex.

Adapter shield 602 may be a three dimensional shape or, as in the best mode now contemplated, may be substantially flat, and somewhat larger in size (radius) than the size (radius) of the interior space outlet aperture, on which it may optionally sit. Adapter shield hand grip extension 604 may allow easy manipulation of the adapter shield, especially during the time a vortex is actually being generated, so that the user may move the base of the vortex, switch to a smaller or larger opening or switch to an opening of different shape. Extension 604 may pass through one of the device's water inlet slots or may pass through a special slot made for the extension in the side walls of the body of the device.

First aperture 606 and second aperture 608 may be different sizes and may be different sizes (radii) from the size (radius) of the outlet aperture. Third aperture 610 may be a different shape than other apertures. In embodiments, the adapter may "plug in" or be otherwise secured in place in the bottom of the interior space. In such embodiments, the extension may be omitted, and the device may screw in or have attachments to secure it to the interior bottom.

Screens may be employed at diverse locations within the device, for example at the top, at the apertures, or as a bottom of the recuperation chamber, at the inlet slots and so on.

The device may have an "open bottomed" recuperation chamber, that is, the recuperation chamber may have no bottom, allowing water which flows into the recuperation chamber via the interior space outlet aperture to fall directly to the bottom of the bathtub.

Figure 8:
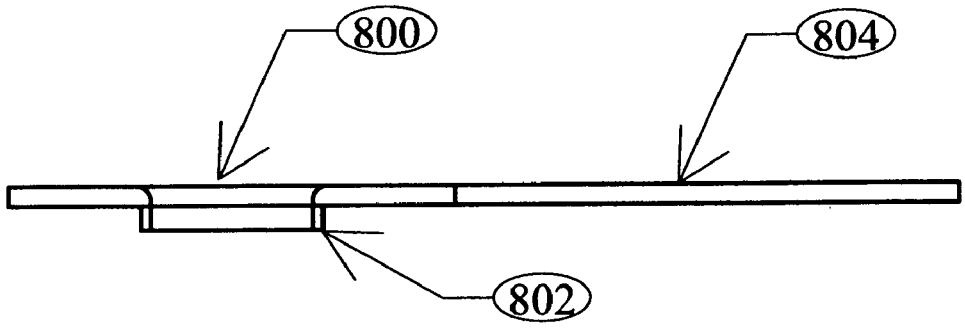
FIG. 8 is a side view of an eighth adapter embodiment of the device, showing details of the device.

FIG. 8 is a side view of an eighth adapter embodiment of the device, showing details of the device aperture 800, which may have a lip 802 or gasket 802 allowing the aperture to be loosely seated within the interior space outlet aperture, whereby motions of the adapter handle extension 804 may move the vortex about. A gasket as the lip forces a larger portion of the water to pass through the vortex in order to escape the interior space.

Figure 9:
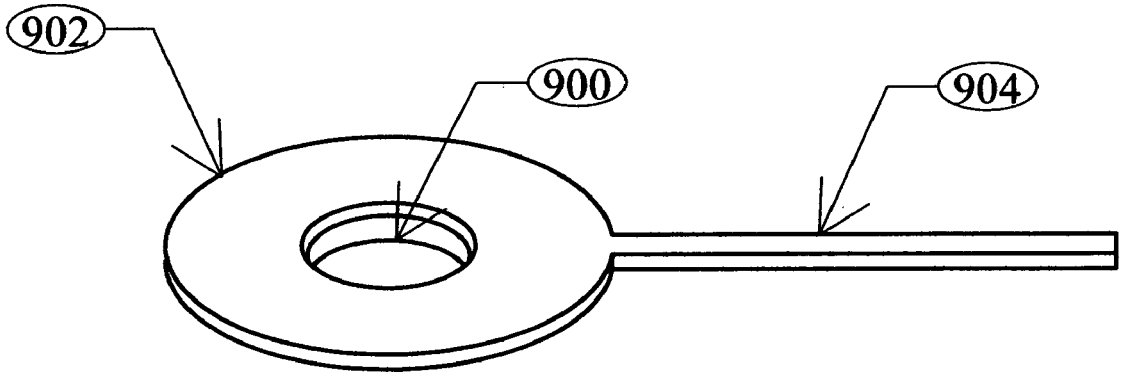
FIG. 9 is a perspective view of a ninth adapter embodiment of the invention, showing details of the adapter.

FIG. 9 is a perspective view of a ninth adapter embodiment of the invention, showing details of the adapter. Aperture and lip/gasket 900 penetrate shield 902, which otherwise blocks exit of the water. Handle extension 904 may be as previously discussed.

Figure 10:
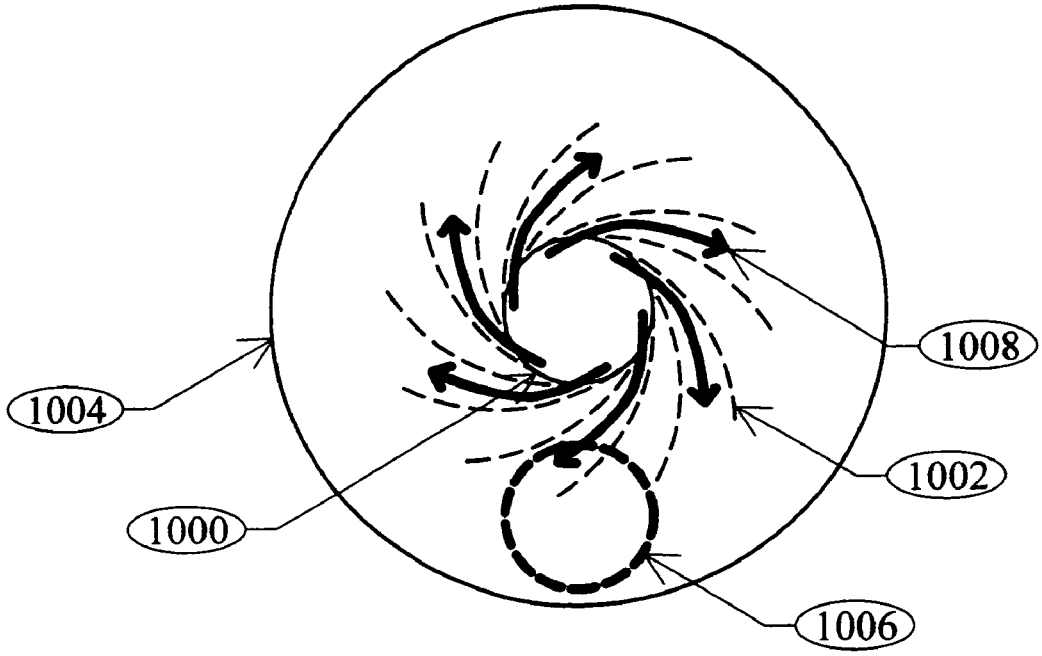
FIG. 10 is a bottom planform view of a tenth embodiment recuperation chamber.
Figure 11:
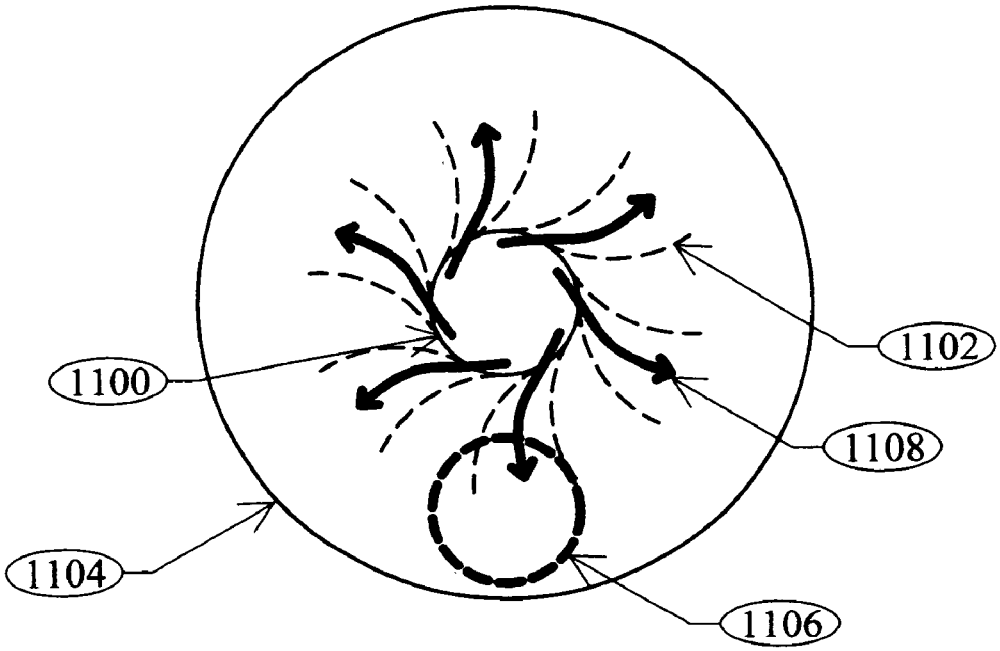
FIG. 11 is a bottom planform view of an eleventh embodiment recuperation chamber.

FIG. 10 is a bottom planform view of a tenth embodiment recuperation chamber, and FIG. 11 is a bottom planform view of an eleventh embodiment recuperation chamber. Interior outlet apertures 1000/1100, gasket/lip 1004/1104, and household fixture drain 1006/1106 may be substantially as previously described in reference to FIGS. 1 through 9. However, it may be seen that vane/fin 1102/1002 may arc in two different directions, resulting in flow 1008/1108 going in either one of two different directions, depending upon the embodiment. It is obvious that different rates of drainage from the recuperation chamber may be achieved in this way, with resulting differences in back pressure and thus differences in the flow and vortex in the interior space (not shown).

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A whirlpool toy for use in a partially enclosed household fixture having water therein and having a drain, the whirlpool toy comprising:

a generally cylindrical body having a first generally cylindrical interior space, the body having a top allowing a clear view of the first interior space and at least one generally vertical side wall;

a first outlet aperture in a bottom of the first interior space, the first outlet aperture located near a center of the bottom of the first interior space;

a first recuperation chamber connected to the first interior space by the first outlet aperture, the first recuperation chamber having an open bottom offering a flow connection to the exterior of the device; and at least one inlet slot extending vertically up a portion of the at least one generally vertical side wall.

2. The whirlpool toy of claim 1, wherein the first recuperation chamber further comprises: fins located within the first recuperation chamber and disposed so as to increase flow of water within the first recuperation chamber, whereby flow out of the first recuperation chamber is increased.

3. The whirlpool toy of claim 1, wherein the inlet slot further comprises: first and second edges of the slot, wherein the first edge is set further from a center of the interior space than the second edge, whereby the slot is disposed along a chord line of the generally cylindrical body, whereby water entering the first interior space from said household fixture does not move in a straight line towards the center of the interior space.

4. The whirlpool toy of claim 3, wherein the cylindrical side wall and the inlet slot and the bottom of the first interior space are substantially smooth, whereby water moving within the first interior space travels in a flow consisting of one member selected from the group consisting of: laminar flow, turbulent flow, and combinations thereof.

5. The whirlpool toy of claim 1, further comprising: at least one gasket dimensioned and configured to secure the device to the bottom of said household fixture.

6. The whirlpool toy of claim 1, wherein the first recuperation chamber is located, dimensioned and configured to offer unimpeded water flow from the first recuperation chamber to said drain.

7. The whirlpool toy of claim 1, wherein the first recuperation chamber is defined by the bottom of the first interior space and the side wall of the body.

8. The whirlpool toy of claim 1, wherein the top allowing a view of the interior of the device further comprises: an open top.

9. The whirlpool toy of claim 1, wherein the top allowing a view of the interior of the device further comprises: a transparent top.

10. The whirlpool toy of claim 1, further comprising: a vortex control adapter having a hand grip extension, a shield disposed at an end of the hand grip extension, and at least one shield aperture passing through the shield, the shield being larger than the first outlet aperture and the at least one shield aperture being smaller than the first outlet aperture.

11. The whirlpool toy of claim 10, wherein the vortex control adapter further comprises: a second shield aperture passing through the shield, the second shield aperture being a different size than the first outlet aperture.

12. The whirlpool toy of claim 4, wherein the edges of the inlet slot are substantially streamlined to reduce turbulent flow.

13. The whirlpool toy of claim 1, wherein the inlet slot further comprises: at least one entry vane directing water flowing through the inlet vane in a direction substantially perpendicular to the center of the first interior space.

14. The whirlpool toy of claim 10, wherein the hand grip extension further extends a sufficient distance to extend out of the first interior space, whereby a user may manipulate the vortex control adapter while the toy is generating a vortex.

15. The whirlpool toy of claim 1, wherein at least one inlet slot extends vertically up a substantial portion of the at least one generally vertical side wall.

16. A whirlpool toy for use in a partially enclosed household fixture having water therein and having a drain, the whirlpool toy comprising:

a generally cylindrical body having a first generally cylindrical interior space, the body having a top allowing a clear view of the first interior space and at least one generally vertical side wall;

a first outlet aperture in a bottom of the first interior space, the first outlet aperture located near a center of the bottom of the first interior space;

a second interior space connected to the first interior space by the first outlet aperture, the second interior space having an open bottom offering a flow connection to the exterior of the device; and at least one inlet slot extending vertically up a portion of the at least one generally vertical side wall.

17. The whirlpool toy of claim 16, wherein the second interior space is lower than the first interior space.

* * * * *